US006192335B1

(12) United States Patent
Ekudden et al.

(10) Patent No.: US 6,192,335 B1
(45) Date of Patent: Feb. 20, 2001

(54) ADAPTIVE COMBINING OF MULTI-MODE CODING FOR VOICED SPEECH AND NOISE-LIKE SIGNALS

(75) Inventors: Erik Ekudden, Äkersberga; Roar Hagen, Stockholm, both of (SE)

(73) Assignee: Telefonaktieboiaget LM Ericsson (publ), Stockholm (SE)

( * ) Notice: Under 35 U.S.C. 154(b), the term of this patent shall be extended for 0 days.

(21) Appl. No.: 09/144,961

(22) Filed: Sep. 1, 1998

(51) Int. Cl.[7] ..... G10L 11/04
(52) U.S. Cl. ..... 704/223; 704/219
(58) Field of Search ..... 704/207, 208, 704/214, 223

(56) References Cited

U.S. PATENT DOCUMENTS

| | | | | |
|---|---|---|---|---|
| 4,969,193 | * | 11/1990 | Scott et al. | 704/207 |
| 5,060,269 | | 10/1991 | Zinser | 704/220 |
| 5,517,595 | * | 5/1996 | Kleijn | 704/205 |
| 5,602,959 | * | 2/1997 | Bergstrom et al. | 704/205 |
| 5,649,051 | * | 7/1997 | Rothweler et al. | 704/222 |
| 5,657,418 | | 8/1997 | Gerson et al. | 704/207 |
| 5,668,925 | * | 9/1997 | Rothweiler et al. | 704/220 |
| 5,715,365 | * | 2/1998 | Griffin et al. | 704/214 |
| 5,742,930 | * | 4/1998 | Howitt | 704/502 |
| 5,794,186 | * | 8/1998 | Bergstrom et al. | 704/223 |
| 5,812,965 | | 9/1998 | Massaloux | 704/205 |
| 5,819,224 | * | 10/1998 | Xydeas | 704/266 |
| 5,826,222 | * | 10/1998 | Griffin | 704/207 |
| 5,899,968 | * | 5/1999 | Navarro et al. | 704/220 |
| 5,963,898 | * | 10/1999 | Navarro et al. | 704/220 |
| 5,974,377 | * | 10/1999 | Navarro et al. | 704/220 |
| 6,012,023 | * | 1/2000 | Iijami et al. | 704/207 |

FOREIGN PATENT DOCUMENTS

| | | | |
|---|---|---|---|
| 0523979 | 1/1993 | (EP) | G10L/7/00 |
| 0768770 | 4/1997 | (EP) | H04J/3/17 |
| 0852376 | 7/1998 | (EP) | G10L/9/14 |
| 9425959 | 11/1994 | (WO) | G10L/3/02 |

OTHER PUBLICATIONS

1997 IEEE, Corporate Research, Texas Instruments, Dallas, TX, "A Variable–Rate Multimodal Speech Coder With Gain–Matched Analysis–By–Synthesis", Erdal Paksoy et al., pp. 751–754.

IEEE Journal on Selected Areas Communications, vol. 10, No. 5, Jun. 1992, "Techniques for Improving the Performance of CELP–Type Speech Coders", Ira A. Gerson et al., pp. 858–862.

European Telecommunication Standard, Global System for Mobile Communications, Digital Cellular Telecommunications System (Phase 2); Half Rate Speech: Part 2: Half Rate Speech Transcoding (GSM 06.20 version 4.3.0); Dec. 1997.

Prentice–Hall 1978, Engleood Cliffs, US, "Digital Processing of Speech Signals", Rabiner et al., pp. 158–161, XP002084303.

* cited by examiner

*Primary Examiner*—Krista Zele
*Assistant Examiner*—Michael N. Opsasnick
(74) *Attorney, Agent, or Firm*—Jenkens & Gilchrist

(57) ABSTRACT

In producing from an original speech signal a plurality of parameters from which an approximation of the original speech signal can be reconstructed, a coded signal of the original speech signal is generated. At least one of the parameters is determined using first and second differences between the original speech signal and the coded signal. The first difference is a difference between a waveform associated with the original speech signal and a waveform associated with the coded signal, and the second difference is a difference between an energy parameter derived from the original speech signal and a corresponding energy parameter associated with the coded signal.

26 Claims, 5 Drawing Sheets

ADAPTIVE COMBINING OF MULTI-MODE CODING FOR VOICED SPEECH AND NOISE-LIKE SIGNALS

FIELD OF THE INVENTION

The invention relates generally to speech coding and, more particularly, to improved coding criteria for accommodating noise-like signals at lowered bit rates.

BACKGROUND OF THE INVENTION

Most modern speech coders are based on some form of model for generation of the coded speech signal. The parameters and signals of the model are quantized and information describing them is transmitted on the channel. The dominant coder model in cellular telephony applications is the Code Excited Linear Prediction (CELP) technology.

A conventional CELP decoder is depicted in FIG. 1. The coded speech is generated by an excitation signal fed through an all-pole synthesis filter with a typical order of 10. The excitation signal is formed as a sum of two signals ca and cf, which are picked from respective codebooks (one fixed and one adaptive) and subsequently multiplied by suitable gain factors ga and gf. The codebook signals are typically of length 5 ms (a subframe) whereas the synthesis filter is typically updated every 20 ms (a frame). The parameters associated with the CELP model are the synthesis filter coefficients, the codebook entries and the gain factors.

In FIG. 2, a conventional CELP encoder is depicted. A replica of the CELP decoder (FIG. 1) is used to generate candidate coded signals for each subframe. The coded signal is compared to the uncoded (digitized) signal at 21 and a weighted error signal is used to control the encoding process. The synthesis filter is determined using linear prediction (LP). This conventional encoding procedure is referred to as linear prediction analysis-by synthesis (LPAS).

As understood from the description above, LPAS coders employ waveform matching in a weighted speech domain, i.e., the error signal is filtered with a weighting filter. This can be expressed as minimizing the following squared error criterion:

$$D_W=\|S_W-CS_W\|^2=\|W\cdot S-W\cdot H\cdot(ga\cdot ca+gf\cdot cf)\|^2 \qquad \text{(Eq. 1)}$$

where S is the vector containing one subframe of uncoded speech samples, $S_W$ represents S multiplied by the weighting filter W, ca and cf are the code vectors from the adaptive and fixed codebooks respectively, W is a matrix performing the weighting filter operation, H is a matrix performing the synthesis filter operation, and $CS_W$ is the coded signal multiplied by the weighting filter W. Conventionally, the encoding operation for minimizing the criterion of Equation 1 is performed according to the following steps:

Step 1. Compute the synthesis filter by linear prediction and quantize the filter coefficients. The weighting filter is computed from the linear prediction filter coefficients.

Step 2. The code vector ca is found by searching the adaptive codebook to minimize $D_W$ of Equation 1 assuming that gf is zero and that ga is equal to the optimal value. Because each code vector ca has conventionally associated therewith an optimal value of ga, the search is done by inserting each code vector ca into Equation 1 along with its associated optimal ga value.

Step 3. The code vector cf is found by searching the fixed codebook to minimize $D_W$, using the code vector ca and gain ga found in step 2. The fixed gain gf is assumed equal to the optimal value.

Step 4. The gain factors ga and gf are quantized. Note that ga can be quantized after step 2 if scalar quantizers are used.

The waveform matching procedure described above is known to work well, at least for bit rates of say 8 kb/s or more. However, when lowering the bit rate, the ability to do waveform matching of non-periodic, noise-like signals such as unvoiced speech and background noise suffers. For voiced speech segments, the waveform matching criterion still performs well, but the poor waveform matching ability for noise-like signals leads to a coded signal with an often too low level and an annoying varying character (known as swirling).

For noise-like signals, it is well known in the art that it is better to match the spectral character of the signal and have a good signal level (gain) matching. Since the linear prediction synthesis filter provides the spectral character of the signal, an alternative criterion to Equation 1 above can be used for noise-like signals:

$$D_E=(\sqrt{E_S}-\sqrt{\sqrt{E_{CS}}})^2 \qquad \textit{(Eq. 2)}$$

where $E_S$ is the energy of the uncoded speech signal and $E_{CS}$ is the energy of the coded signal CS=H·(ga·ca+gf·cf). Equation 2 implies energy matching as opposed to waveform matching in Equation 1. This criterion can also be used in the weighted speech domain by including the weighting filter W. Note that the square root operations are included in Equation 2 only to have a criterion in the same domain as Equation 1; this is not necessary and is not a restriction. There are also other possible energy-matching criteria such as $D_E=|E_S-E_{CS}|$.

The criterion can also be formulated in the residual domain as follows:

$$D_E=(\sqrt{E_r}-\sqrt{E_x})^2 \qquad \text{(Eq. 3)}$$

where $E_r$ is the energy of the residual signal r obtained by filtering S through the inverse ($H^{-1}$) of the synthesis filter, and $E_x$ is the energy of the excitation signal given by x=ga·ca+gf·cf.

The different criteria above have been employed in conventional multi-mode coding where different coding modes (e.g., energy matching) have been used for unvoiced speech and background noise. In these modes, energy matching criteria as in Equations 2 and 3 have been used. A drawback with this approach is the need for mode decision, for example, choosing waveform matching mode (Equation 1) for voiced speech and choosing energy matching mode (Equations 2 or 3) for noise-like signals like unvoiced speech and background noise. The mode decision is sensitive and causes annoying artifacts when wrong. Also, the drastic change of coding strategy between modes can cause unwanted sounds.

It is therefore desirable to provide improved coding of noise-like signals at lowered bit rates without the aforementioned disadvantages of multi-mode coding.

The present invention advantageously combines waveform matching and energy matching criteria to improve the coding of noise-like signals at lowered bit rates without the disadvantages of multi-mode coding.

DETAILED DESCRIPTION

Figure 3:
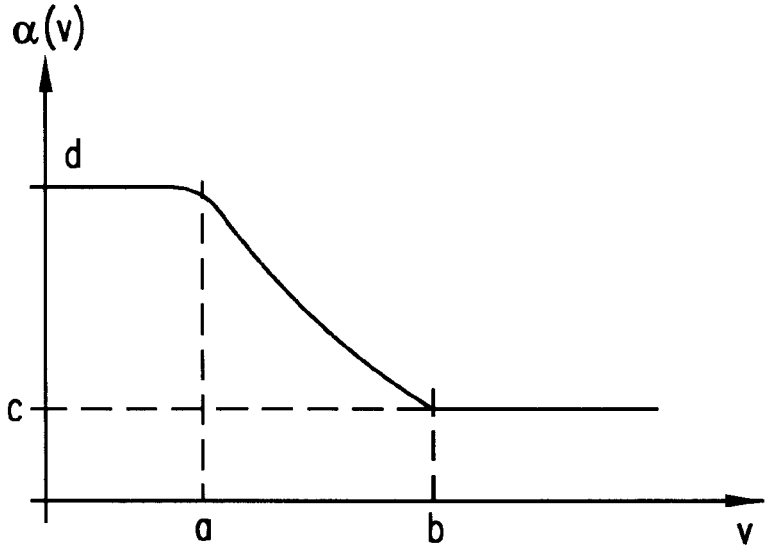
FIG. 3 illustrates graphically a balance factor according to the invention.

The present invention combines waveform matching and energy matching criteria into one single criterion $D_{WE}$. The balance between waveform matching and energy matching is softly adaptively adjusted by weighting factors:

$$D_{WE}=K\cdot D_W+L\cdot D_E \quad \text{(Eq. 4)}$$

where K and L are weighting factors determining the relative weights between the waveform matching distortion $D_W$ and the energy matching distortion $D_E$. Weighting factors K and L can be respectively set to equal $1-\alpha$ and $\alpha$ as follows:

$$D_{WE}=(1-\alpha)\cdot D_W+\alpha\cdot D_E \quad \text{(Eq. 5)}$$

where $\alpha$ is a balance factor having a value from 0 to 1 to provide the balance between the waveform matching part $D_W$ and the energy matching part $D_E$ of the criterion. The $\alpha$ value is preferably a function of the voicing level, or periodicity, in the current speech segment, $\alpha=\alpha(\nu)$ where $\nu$ is a voicing indicator. A principle sketch of an example of the $\alpha(\nu)$ function is shown in FIG. 3. At voicing levels below a, $\alpha$=d, at voicing levels above b, $\alpha$=c, and a decreases gradually from d to c at voicing levels between a and b.

In one specific formulation the criterion of Equation 5 can be expressed as:

$$D_{WE}=(1-\alpha)\cdot\|S_W-CS_W\|^2+\alpha\cdot(\sqrt{E_{SW}}-\sqrt{E_{CSW}})^2 \quad \text{(Eq. 6)}$$

where $E_{SW}$ is the energy of the signal $S_W$ and $E_{CSW}$ is the energy of the signal $CS_W$.

Although the criterion of Equation 6 above, or a variation thereof, can be advantageously used for the entire coding process in a CELP coder, significant improvements result when it is used only in the gain quantization part (i.e., step 4 of the encoding method above). Although the description here details the application of the criterion of Equation 6 to gain quantization, it can be employed in the search of the ca and cf codebooks in a similar manner.

Note that $E_{CSW}$ of Equation 6 can be expressed as:

$$E_{CSW}=\|CS_W\|^2 \quad \text{(Eq. 7)}$$

so that Equation 6 can be rewritten as:

$$D_{WE}=(1-\alpha)\cdot\|S_W-CS_W\|^2+\alpha\cdot(\sqrt{E_{SW}}-\sqrt{\|CS_W\|^2})^2. \quad \text{(Eq. 8)}$$

It can be seen from Equation 1 that:

$$CS_W=W\cdot H\cdot(ga\cdot ca+gf\cdot cf). \quad \text{(Eq. 9)}$$

Once the code vectors ca and cf are determined, for example using Equation 1 and Steps 1–3 above, the task is to find the corresponding quantized gain values. For vector quantization, these quantized gain values are given as an entry from the codebook of the vector quantizer. This codebook includes plural entries, and each entry includes a pair of quantized gain values, $ga_Q$ and $gf_Q$.

Inserting all pairs of quantized gain values $ga_Q$ and $gf_Q$ from the vector quantizer codebook into Equation 9, and then inserting each resulting $CS_W$ into Equation 8, all possible values of $D_{WE}$ in Equation 8 are computed. The gain value pair from the codebook of the vector quantizer giving the least value of $D_{WE}$ is selected for the quantized gain values.

In several modern coders, predictive quantization is used for the gain values, or at least for the fixed codebook gain value. This is straightforwardly incorporated in Equation 9 because the prediction is done before the search. Instead of plugging codebook gain values into Equation 9, the codebook gain values multiplied by the predicted gain values are plugged into Equation 9. Each resulting CSW is then inserted in Equation 8 as above.

For scalar quantization of the gain factors, a simple criterion is often used where the optimal gain is quantized directly, i.e., a criterion like:

$$D_{SGQ}=(g_{OPT}-g)^2 \quad \text{(Eq. 10)}$$

is used, where $D_{SGQ}$ is the scalar gain quantization criterion, $g_{OPT}$ is the optimal gain (either $ga_{OPT}$ or $gf_{OPT}$) as conventionally determined in Step 2 or 3 above, and g is a quantized gain value from the codebook of either the ga or gf scalar quantizer. The quantized gain value that minimizes $D_{SGQ}$ is selected.

In quantizing the gain factors, the energy matching term may, if desired, be advantageously employed only for the fixed codebook gain since the adaptive codebook usually plays a minor role for noise-like speech segments. Thus, the criterion of Equation 10 can be used to quantize the adaptive codebook gain while a new criterion $D_{gfQ}$ is used to quantize the fixed codebook gain, namely:

$$D_{gfQ}=(1-\alpha)\cdot\|cf\|^2\cdot(gf_{OPT}-gf)^2+\alpha\cdot(\sqrt{E_1}-\sqrt{\|ga_Q\cdot ca+gf\cdot cf\|^2})^2 \quad \text{(Eq. 11)}$$

where $gf_{OPT}$ is the optimal gf value determined from Step 3 above, and $ga_Q$ is the quantized adaptive codebook gain determined using Equation 10. All quantized gain values from the codebook of the gf scalar quantizer are plugged in as gf in Equation 11, and the quantized gain value that minimizes $D_{gfQ}$ is selected.

The adaptation of the balance factor $\alpha$ is a key to obtaining good performance with the new criterion. As described earlier, $\alpha$ is preferably a function of the voicing level. The coding gain of the adaptive codebook is one example of a good indicator of the voicing level. Examples of voicing level determinations thus include:

$$\nu_V 32\ 10\log_{10}(\|r\|^2/\|r-ga_{OPT}\cdot ca\|^2) \quad \text{(Eq. 12)}$$

$$\nu_S 32\ 10\log_{10}(\|r\|^2/\|r-ga_Q\cdot ca\|^2) \quad \text{(Eq. 13)}$$

where $\nu_V$ is the voicing level measure for vector quantization, $\nu_S$ is the voicing level measure for scalar quantization, and r is the residual signal defined hereinabove.

Although the voicing level is determined in the residual domain using Equations 12 and 13, the voicing level can also be determined in, for example, the weighted speech domain by substituting $S_W$ for r in Equations 12 and 13, and multiplying the gaca terms of Equations 12 and 13 by W·H.

To avoid local fluctuation in the ν values, the ν values can be filtered before mapping to the α domain. For instance, a median filter of the current value and the values for the previous 4 subframes can be used as follows:

$$\nu_m = \text{median}(\nu, \nu_{-1}, \nu_{-2}, \nu_{-3}, \nu_{-4}) \quad \text{(Eq. 14)}$$

where $\nu_{-1}$, $\nu_{-2}$, $\nu_{-3}$, $\nu_{-4}$ are the ν values for the previous 4 subframes.

Figure 4:
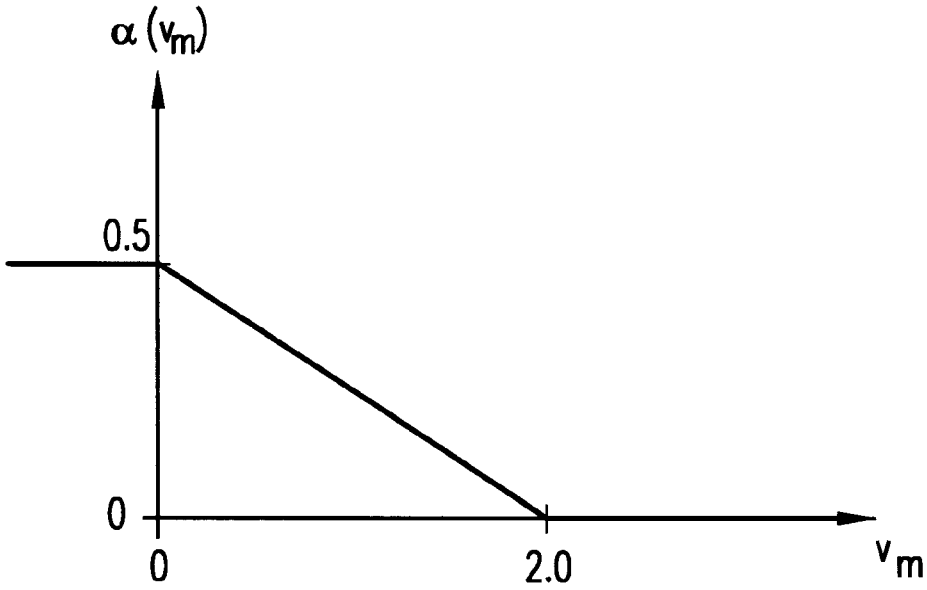
FIG. 4 illustrates graphically a specific example of the balance factor of FIG. 3.

The function shown in FIG. 4 illustrates one example of the mapping from the voicing indicator $\nu_m$ to the balance factor α. This function is mathematically expressed as $$\alpha(\nu_m) = \begin{cases} 0.5 & \nu_m \le 0 \\ 0.5 - 0.25 \cdot \nu_m & 0 < \nu_m < 2.0 \\ 0 & \nu_m \ge 2.0 \end{cases} \quad \text{(Eq. 15)}$$

Note that the maximum value of α is less than 1, meaning that full energy matching never occurs, and some waveform matching always remains in the criterion (see Equation 5).

At speech onsets, when the energy of the signal increases dramatically, the adaptive codebook coding gain is often small due to the fact that the adaptive codebook does not contain relevant signals. However, waveform matching is important at onsets and therefor α is forced to zero if an onset is detected. A simple onset detection based on the optimal fixed codebook gain can be used as follows:

$$\alpha(V_m)=0 \text{ if } gf_{OPT} > 2.0 \cdot gf_{OPT-1} \quad \text{(Eq. 16)}$$

where $gf_{OPT-1}$ is the optimal fixed codebook gain determined in Step 3 above for the previous subframe.

It is also advantageous to limit the increase in the α value when it was zero in the previous subframe. This can be implemented by simply dividing the α value by a suitable number, e.g., 2.0 when the previous α value was zero. Artifacts caused by moving from pure waveform matching to more energy matching are thereby avoided.

Also, once the balance factor a has been determined using Equations 15 and 16, it can be advantageously filtered, for example, by averaging it with α values of previous subframes.

As mentioned above, Equation 6 (and thus Equations 8 and 9) can also be used to select the adaptive and fixed codebook vectors ca and cf. Because the adaptive codebook vector ca is not yet known, the voicing measures of Equations 12 and 13 cannot be calculated, so the balance factor a of Equation 15 also cannot be calculated. Thus, in order to use Equations 8 and 9 for the fixed and adaptive codebook searches, the balance factor α is preferably set to a value which has been empirically determined to yield the desired results for noise-like signals. Once the balance factor α has been empirically determined, then the fixed and adaptive codebook searches can proceed in the manner set forth in Steps 1–4 above, but using the criterion of Equations 8 and 9. Alternatively, after ca and ga are determined in Step 2 using an empirically determined α value, then Equations 12–15 can be used as appropriate to determine a value of α to be used in Equation 8 during the Step 3 search of the fixed codebook.

Figure 2:
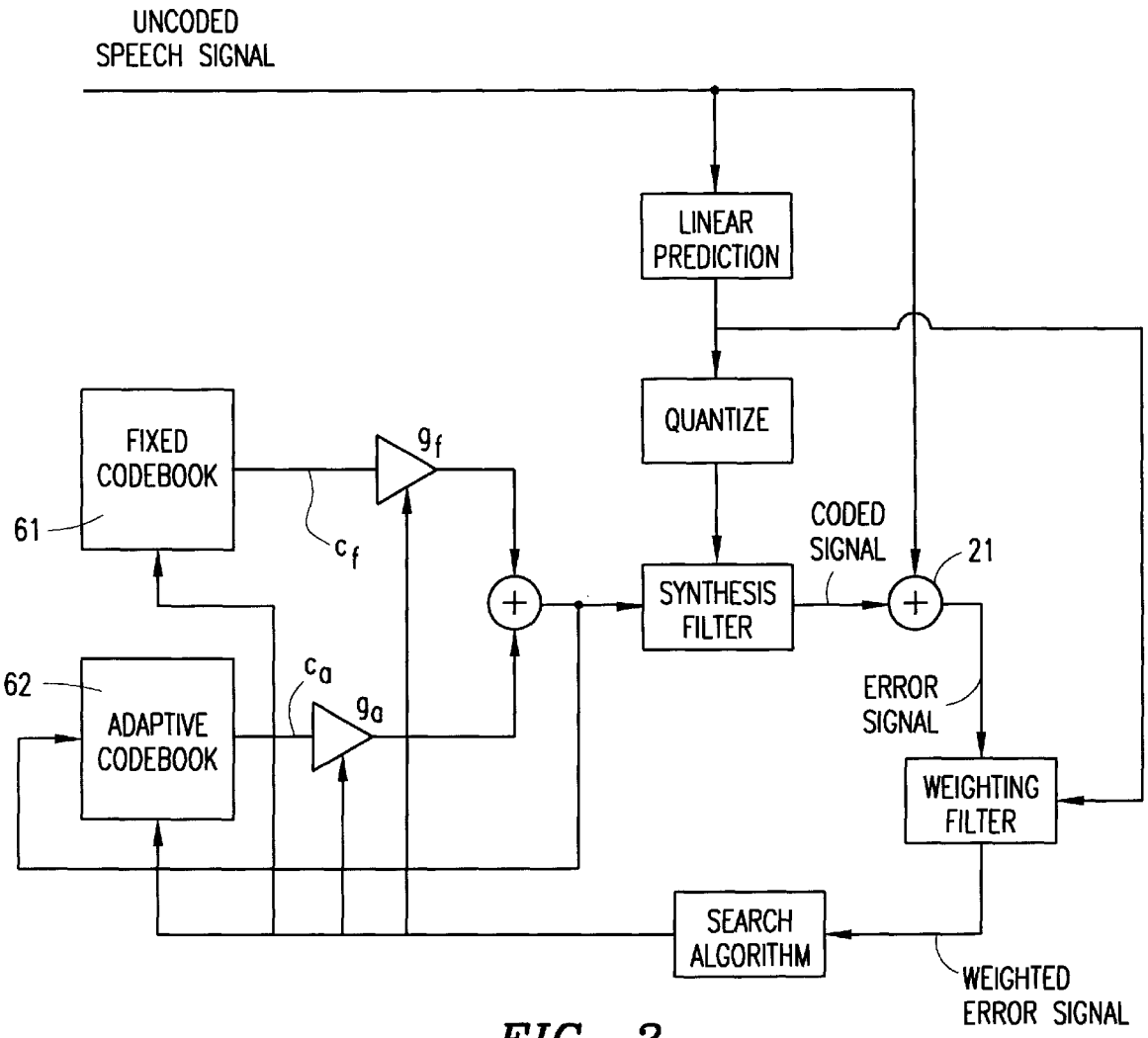
FIG. 2 (PRIOR ART)
FIG. 2 illustrates diagrammatically a conventional CELP encoder.
Figure 5:
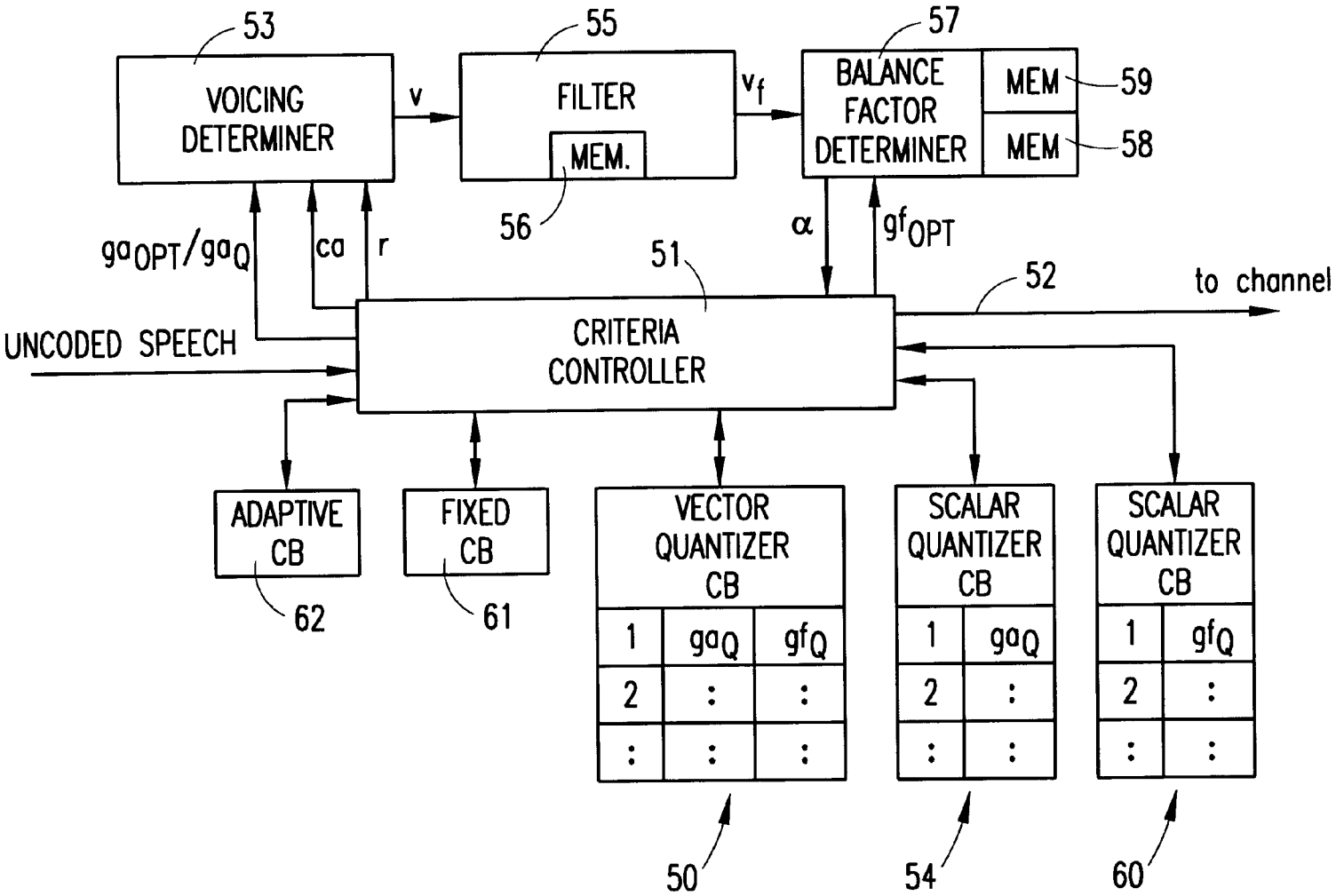
FIG. 5 illustrates diagrammatically a pertinent portion of an exemplary CELP encoder according to the invention.

FIG. 5 is a block diagram representation of an exemplary portion of a CELP speech encoder according to the invention. The encoder portion of FIG. 5 includes a criteria controller 51 having an input for receiving the uncoded speech signal, and also coupled for communication with the fixed and adaptive codebooks 61 and 62, and with gain quantizer codebooks 50, 54 and 60. The criteria controller 51 is capable of performing all conventional operations associated with the CELP encoder design of FIG. 2, including implementing the conventional criteria represented by Equations 1–3 and 10 above, and performing the conventional operations described in Steps 1–4 above.

In addition to the above-described conventional operations, criteria controller 51 is also capable of implementing the operations described above with respect to Equations 4–9 and 11–16. The criteria controller 51 provides a voicing determiner 53 with ca as determined in Step 2 above, and $ga_{OPT}$ (or $ga_Q$ if scalar quantization is used) as determined by executing Steps 1–4 above. The criteria controller further applies the inverse synthesis filter $H^{-1}$ to the uncoded speech signal to thereby determine the residual signal r, which is also input to the voicing determiner 53.

The voicing determiner 53 responds to its above-described inputs to determine the voicing level indicator ν according to Equation 12 (vector quantization) or Equation 13 (scalar quantization). The voicing level indicator ν is provided to the iv input of a filter 55 which subjects the voicing level indicator ν to a filtering operation (such as the median filtering described above), thereby producing a filtered voicing level indicator $\nu_f$ as an output. For median filtering, the filter 55 may include a memory portion 56 as shown for storing the voicing level indicators of previous subframes.

The filtered voicing level indicator $\nu_f$ output from filter 55 is input to a balance factor determiner 57. The balance factor determiner 57 uses the filtered voicing level indicator $\nu_f$ to determine the balance factor α, for example in the manner described above with respect to Equation 15 (where $\nu_m$ represents a specific example of $\nu_f$ of FIG. 5) and FIG. 4. The criteria controller 51 input to the balance factor determiner 57 $gf_{OPT}$ for the current subframe, and this value can be stored in a memory 58 of the balance factor determiner 57 for use in implementing Equation 16. The balance factor determiner also includes a memory 59 for storing the a value of each subframe (or at least α values of zero) in order to permit the balance factor determiner 57 to limit the increase in the a value when the α value associated with the previous subframe was zero.

Once the criteria controller 51 has obtained the synthesis filter coefficients, and has applied the desired criteria to determine the codebook vectors and the associated quantized gain values, then information indicative of these parameters is output from the criteria controller at 52 to be transmitted across a communication channel.

FIG. 5 also illustrates conceptually the codebook 50 of a vector quantizer, and the codebooks 54 and 60 of respective scaler quantizers for the adaptive codebook gain value ga and the fixed codebook gain value gf. As described above, the vector quantizer codebook 50 includes a plurality of entries, each entry including a pair of quantized gain values $ga_Q$ and $gf_Q$. The scalar quantizer codebooks 54 and 60 each include one quantized gain value per entry.

Figure 6:
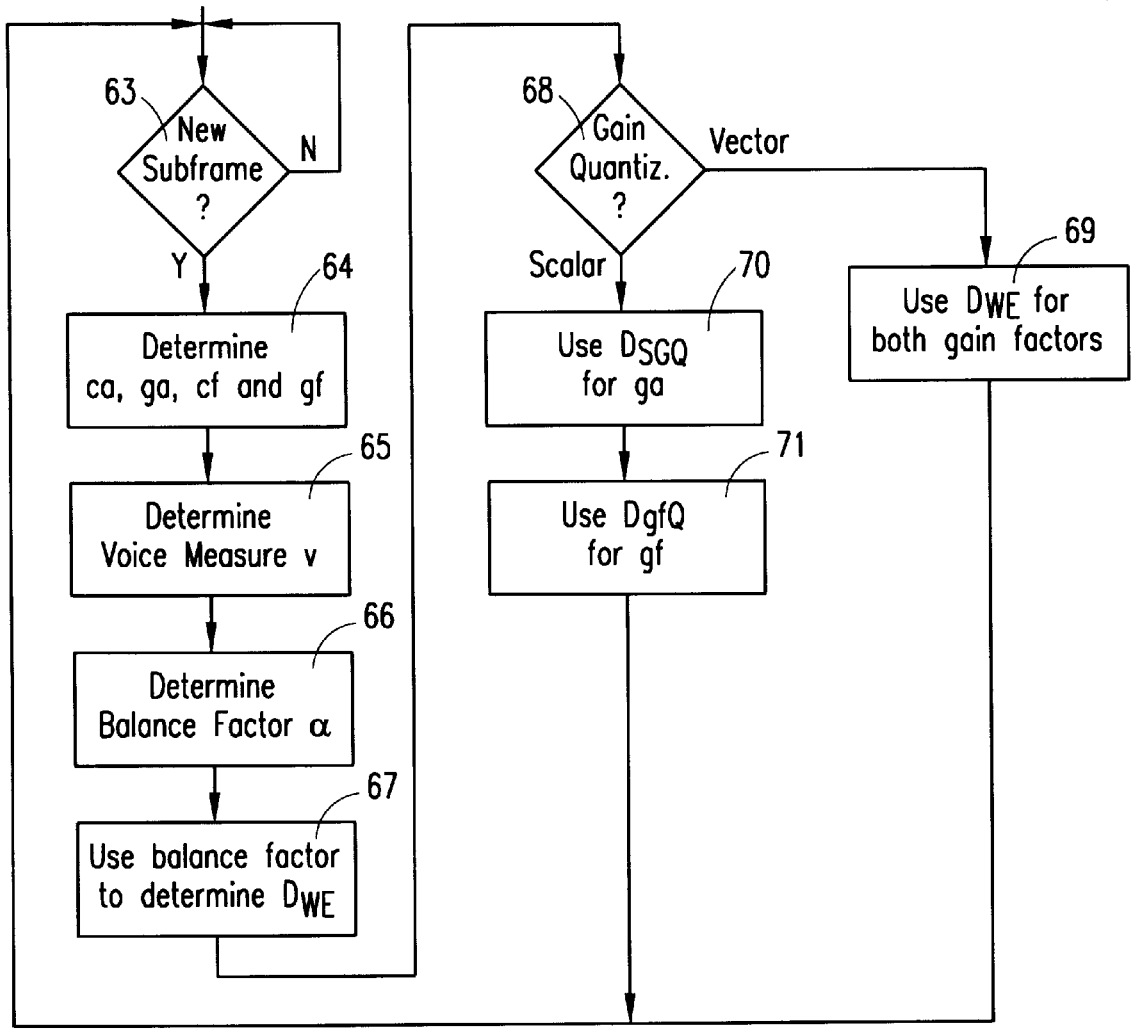
FIG. 6 is a flow diagram which illustrates exemplary operations of the CELP encoder portion of FIG. 5.

FIG. 6 illustrates in flow diagram format exemplary operations (as described in detail above) of the example encoder portion of FIG. 5. When a new subframe of uncoded speech is received at 63, Steps 1–4 above are executed according to a desired criterion at 64 to determine ca, ga, cf and gf. Thereafter at 65, the voicing measure ν is determined, and the balance factor α is thereafter determined at 66. Thereafter, at 67, the balance factor is used to define the criterion for gain factor quantization, $D_{WE}$, in terms of waveform matching and energy matching. If vector quantization is being used at 68, then the combined waveform matching/energy matching criterion $D_{WE}$ is used to quantize both of the gain factors at 69. If scalar quantization is being used, then at 70 the adaptive codebook gain ga is quantized using $D_{SGQ}$ of Equation 10, and at 71 the fixed codebook gain gf is quantized using the combined waveform matching/energy matching criterion $D_{gfQ}$ of Equation 11. After the gain factors have been quantized, the next subframe is awaited at 63.

Figure 1:
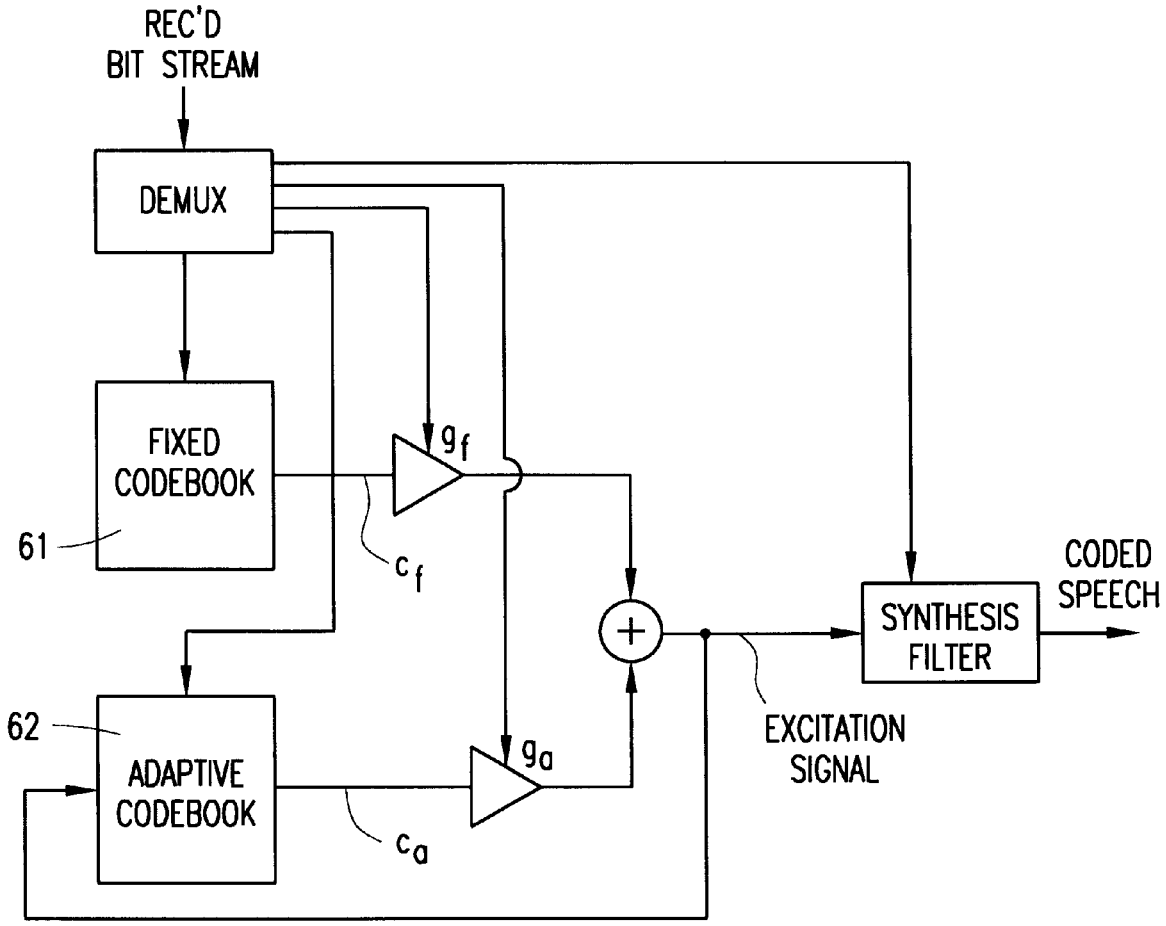
FIG. 1 (PRIOR ART)
FIG. 1 illustrates diagrammatically a conventional CELP decoder.
Figure 7:
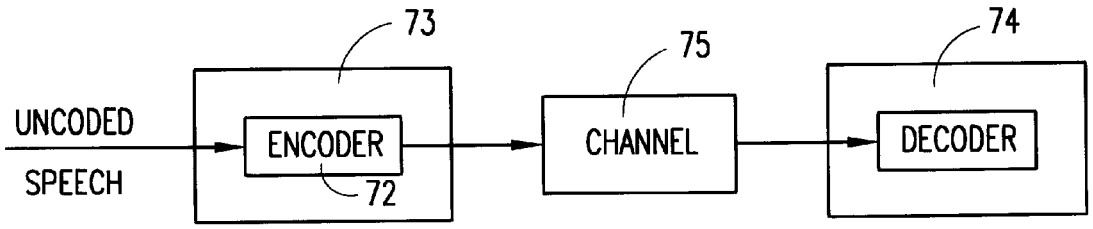
FIG. 7 illustrates diagrammatically a communication system according to the invention.

FIG. 7 is a block diagram of an example communication system including a speech encoder according to the present invention. In FIG. 7, an encoder 72 according to the present invention is provided in a transceiver 73 which communicates with a transceiver 74 via a communication channel 75. The encoder 72 receives an uncoded speech signal, and provides to the channel 75 information from which a conventional decoder 76 (such as described above with respect to FIG. 1) in transceiver 74 can reconstruct the original speech signal. As one example, the transceivers 73 and 74 of FIG. 7 could be cellular telephones, and the channel 75 could be a communication channel through a cellular telephone network. Other applications for the speech encoder 72 of the present invention are numerous and readily apparent.

It will be apparent to workers in the art that a speech encoder according to the invention can be readily implemented using, for example, a suitably programmed digital signal processor (DSP) or other data processing device, either alone or in combination with external support logic.

The new speech coding criterion softly combines waveform matching and energy matching. Therefore, the need to use either one or the other is avoided, but a suitable mixture of the criteria can be employed. The problem of wrong mode decisions between criteria is avoided. The adaptive nature of the criterion makes it possible to smoothly adjust the balance of the waveform and energy matching. Therefore, artifacts due to drastically changing the criterion are controlled.

Some waveform matching can always be maintained in the new criterion. The problem of a completely unsuitable signal with a high level sounding like a noise-burst can thus be avoided.

Although exemplary embodiments of the present invention have been described above in detail, this does not limit the scope of the invention, which can be practiced in a variety of embodiments.

What is claimed is:

1. A method of producing from an original speech signal a plurality of parameters from which an approximation of the original speech signal can be reconstructed, comprising:

generating in response to the original speech signal a coded signal of the original speech signal;

determining a first difference between a waveform associated with the original speech signal and a waveform associated with the coded signal;

determining a second difference between an energy parameter derived from the original speech signal and a corresponding energy parameter associated with the coded signal; and using the first and second differences to determine at least one of the parameters from which the approximation of the original speech signal can be reconstructed.

2. The method of claim 1, further comprising the step of:

calculating a balance factor for the first and second differences in the determination of the at least one parameter, wherein said balance factor indicates a relative importance between said first and second differences.

3. The method of claim 2, including using the balance factor to determine first and second weighting factors respectively associated with the first and second differences, said step of using the first and second differences including multiplying the first and second differences by the first and second weighting factors, respectively.

4. The method of claim 3, wherein said step of using the balance factor to determine first and second weighting factors includes selectively setting one of the weighting factors to zero said weighting factor set to zero determining a relative weight of an energy matching distortion.

5. The method of claim 4, wherein said step of selectively setting one of the weighting factors to zero includes detecting a speech onset in the original speech signal, and setting the second weighting factor to zero in response to detection of the speech onset.

6. The method of claim 2, wherein said step of calculating the balance factor includes calculating the balance factor based on at least one previously calculated balance factor.

7. The method of claim 6, wherein said step of calculating the balance factor based on a previously calculated balance factor includes limiting the magnitude of the balance factor in response to a previously calculated balance factor having a predetermined magnitude.

8. The method of claim 2, wherein said step of calculating the balance factor includes determining a voicing level associated with the original speech signal, and calculating the balance factor as a function of the voicing level.

9. The method of claim 8, wherein said step of determining the voicing level includes applying a filtering operation to the voicing level to produce a filtered voicing level, said calculating step including calculating the balance factor as a function of the filtered voicing level.

10. The method of claim 9, wherein said step of applying a filtering operation includes applying a median filtering operation, including determining a median voicing level among a group of voicing levels including the voicing level to which the filtering operation is applied and a plurality of previously determined voicing levels associated with the original speech signal.

11. The method of claim 2, further comprising the steps of:

determining first and second weighting factors respectively associated with the first and second differences, including determining a voicing level associated with the original speech signal; and determining the weighting factors as a function of the voicing level.

12. The method of claim 11, wherein said step of determining the first and second weighting factors as a function of the voicing level includes making the first weighting factor larger than the second weighting factor in response to a first voicing level, and making the second weighting factor larger than the first weighting factor in response to a second voicing level that is lower than the first voicing level.

13. The method of claim 1, wherein said using step includes using the first and second differences to determine a quantized gain value for use in reconstructing the original speech signal according to a Code Excited Linear Prediction speech coding process.

14. A speech encoding apparatus, comprising:

an input for receiving an original speech signal;

an output for providing information indicative of parameters from which an approximation of the original speech signal can be reconstructed; and a controller coupled between said input and said output for providing in response to the original speech signal a coded signal representing the original speech signal, said controller determining at least one of said parameters based on first and second differences between the original speech signal and the coded signal, wherein said first difference is a difference between a waveform associated with the original speech signal and a waveform associated with the coded signal, and wherein the second difference is a difference between an energy parameter derived from the original speech signal and a corresponding energy parameter associated with the coded signal.

15. The apparatus of claim 14, including a balance factor determiner for calculating a balance factor indicating a relative importance between the first and second differences in determining said at least one parameter, said balance factor determiner having an output coupled to said controller for providing said balance factor to said controller for use in determining said at least one parameter.

16. The apparatus of claim 15, including a voicing level determiner coupled to said input for determining a voicing level of the original speech signal, said voicing level determiner having an output coupled to an input of said balance factor determiner for providing the voicing level to the balance factor determiner, said balance factor determiner operable to determine said balance factor in response to said voicing level information.

17. The apparatus of claim 16, including a filter coupled between said output of said voicing level determiner and said input of said balance factor determiner for receiving the voicing level from said voicing level determiner and providing to the balance factor determiner a filtered voicing level.

18. The apparatus of claim 17, wherein said filter is a median filter.

19. The apparatus of claim 15, wherein said controller is responsive to said balance factor for determining first and second weighting factors respectively associated with the first and second differences.

20. The apparatus of claim 19, wherein said controller is operable to multiply the first and second differences respectively by the first and second weighting factors in determination of said at least one parameter.

21. The apparatus of claim 20, wherein said controller is operable to set the second difference to zero in response to a speech onset in the original speech signal.

22. The apparatus of claim 15, wherein said balance factor determiner is operable to calculate the balance factor based on at least one previously calculated balance factor.

23. The apparatus of claim 22, wherein said balance factor determiner is operable to limit the magnitude of the balance factor responsive to a previously calculated balance factor having a predetermined magnitude.

24. The apparatus of claim 14, wherein said speech encoding apparatus includes a Code Excited Linear Prediction speech encoder, and wherein said at least one parameter is a quantized gain value.

25. A transceiver apparatus for use in a communication system, comprising:

an input for receiving a user input stimulus;

an output for providing an output signal to a communication channel for transmission to a receiver via the communication channel; and a speech encoding apparatus having an input coupled to said transceiver input and having an output coupled to said transceiver output, said input of said speech encoding apparatus for receiving an original speech signal from said transceiver input, said output of said speech encoding apparatus for providing to said transceiver output information indicative of parameters from which an approximation of the original speech signal can be reconstructed at the receiver, said speech encoding apparatus including a controller coupled between said input and said output thereof for providing in response to the original speech signal a coded signal of the original speech signal, said controller further for determining at least one of said parameters based on first and second differences between the original speech signal and the coded signal, wherein said first difference is a difference between a waveform associated with the original speech signal and a waveform associated with the coded signal, and wherein the second difference is a difference between an energy parameter derived from the original speech signal and a corresponding energy parameter associated with the coded signal.

26. The apparatus of claim 25, wherein the transceiver apparatus forms a portion of a cellular telephone.

* * * * *

UNITED STATES PATENT AND TRADEMARK OFFICE

CERTIFICATE OF CORRECTION

PATENT NO. : 6,192,335 B1
DATED : February 20, 2001
INVENTOR(S) : Ekudden et al.

It is certified that error appears in the above-identified patent and that said Letters Patent is hereby corrected as shown below:

Column 3,
Line 38, replace "and a decreases" with -- and ∝ decreases --

Column 4,
Line 59, replace "$V_v$32 10 $\log_{10}$ ($|r|^2/|r\text{-}ga_{OPT}\ ca|^2$) (Eq. 12)" with -- $V_v = 10 \log_{10} (|r|^2/|r\text{-}ga_{OPT}\ ca|^2$ (Eq. 12)--
Line 61, replace "$V_s$32 10 $\log_{10}$ ($|r|^2/|r\text{-}ga_{Q.}\ ca|^2$) (Eq. 13)" with -- $V_s = 10 \log_{10} (|r|^2/|r\text{-}ga_{Q.}\ ca|^2)$ (Eq. 13) --

Column 5,
Line 3, replace "gaca" with -- ga.ca --
Line 44, replace "factor a" with -- factor ∝ --
Line 53, replace "a of equation 15" with -- ∝ of equation 15 --

Column 6,
Line 42, replace "the a value" with -- the α value --
Line 45, replace "in the a value" with -- in the α value --

Signed and Sealed this

Fourth Day of December, 2001

*Attest:*

Nicholas P. Godici

*Attesting Officer*

NICHOLAS P. GODICI
*Acting Director of the United States Patent and Trademark Office*